US005423424A

United States Patent [19]

Young, III

[11] Patent Number: 5,423,424

[45] Date of Patent: Jun. 13, 1995

[54] STORAGE CASE FOR COMPUTER CARDS

[75] Inventor: Francis A. Young, III, Corvallis, Oreg.

[73] Assignee: Hewlett-Packard Corporation, Palo Alto, Calif.

[21] Appl. No.: 210,249

[22] Filed: Mar. 15, 1994

Related U.S. Application Data

[63] Continuation of Ser. No. 6,891, Jan. 21, 1993, abandoned.

[51] Int. Cl.[6] ..... B65D 6/04

[52] U.S. Cl. ..... 206/425; 206/449; 206/308.3; 220/4.27; 220/520; 220/531

[58] Field of Search ..... 206/444, 449, 555, 425, 206/315.11, 494; 220/4.26, 4.27, 520, 529, 531, 23.83

[56] References Cited

U.S. PATENT DOCUMENTS

| | | | |
|---|---|---|---|
| 3,948,579 | 4/1976 | Schirmer | 220/520 x |
| 4,240,222 | 12/1980 | Covington | 206/315.11 X |
| 4,807,773 | 2/1989 | Tsai | 220/4.27 |
| 4,848,585 | 7/1989 | Snyder | 220/4.27 X |

*Primary Examiner*—Jacob K. Ackun

[57] ABSTRACT

A multiple section card case for storing computer cards, such as PCMCIA cards. The multiple section card case includes a top piece, a bottom piece, and a plurality of intermediate pieces interchangeably coupled to each other. When coupled together, the top, bottom, and intermediate pieces form a plurality of card storage sections that may be independently accessed. Each case section may be opened or closed by rotating adjacent pieces forming the section away from or toward each other. Case sections may be removed or added by decoupling an intermediate piece and then adding or removing intermediate pieces.

14 Claims, 3 Drawing Sheets

STORAGE CASE FOR COMPUTER CARDS

This is a continuation of application Ser. No. 08/006,891, filed on Jan. 21, 1993, now abandoned.

FIELD OF INVENTION

This invention relates to a multiple section card case for storing computer cards. More particularly, this invention relates to a method and apparatus for storing a plurality of computer cards in a card case with interchangeable sections enabling one to adjust the capacity of the card case.

BACKGROUND AND SUMMARY OF THE INVENTION

As notebook and palmtop computers became more prevalent, the Personal Computer Memory Card International Association ("PCMCIA") adopted an industry standard setting forth size and interface requirements for credit card-like memory and input/output devices. Since the adoption of the PCMCIA standard, the computer industry has produced various memory and interface devices compatible with the standard.

As more PCMCIA cards become available, users of notebook and palmtop computers find it convenient to have a device for storing PCMCIA cards. Typically, computer users store PCMCIA cards in single plastic cases. These single cases are unsatisfactory because they do not enable the user to organize and conveniently carry several PCMCIA cards. There is a need, thus, to develop a multiple section card case for conveniently storing several PCMCIA cards.

To address this need, the present invention provides a multiple section card case with a plurality of interchangeable case sections. In the preferred embodiment, the case sections are interchangeably coupled to adjacent sections at common axes between the adjacent sections. The case sections are coupled such that the sections may rotate to open and close about the common axes between adjacent case sections.

In greater detail, a preferred embodiment of the invention includes a top piece, a bottom piece and any number of intermediate pieces coupled between the top and bottom pieces. Each piece, desirably made of a molded transparent plastic, is interchangeably coupled to adjacent pieces at corresponding pairs of pegs and holes. Forming a common axis between adjacent pieces, the pegs and holes enable one to rotate the pieces away from or toward each other. To adjust the capacity of the case, one may flex the plastic such that the pegs may be removed from the holes and then easily snapped back into place. The multiple section case includes several storage sections formed by cavities, and the walls and planar surfaces of each piece. The invention, thus, provides an adjustable multisection card case.

The present invention has several advantages over the single storage case. The multiple section card case may store any number of cards by simply coupling a desired number of card sections. Since each case section is coupled to an adjacent section, the multiple section card case prevents individual cards from becoming separated or lost. Each case section is equally accessible because one may open and close a case section without disturbing the other case sections.

While this disclosure specifically describes a multisection card case for storing PCMCIA cards, it should be understood that the invention may include a multisection storage case for storing substantially planar objects including, but not limited to, compact discs, floppy discs, cassettes, etc.

The foregoing and other objects, features, and advantages of the invention will become more apparent from the following detailed description of the preferred embodiment, which proceeds with reference to the accompanying drawings.

DETAILED DESCRIPTION OF THE EMBODIMENTS

FIGS. 1–4 show various views of components of a multiple section card case 10 according to the invention. The multisection card case includes a top 40 and bottom piece 42 and a plurality of intermediate sections 44. The components of the multiple section card case are constructed of a transparent, molded plastic. Preferably the plastic should be resilient to enable the sections of the case to be coupled and decoupled numerous times. The components may, however, be constructed from various materials depending on the particular environment and application of the card case.

Figure 1:
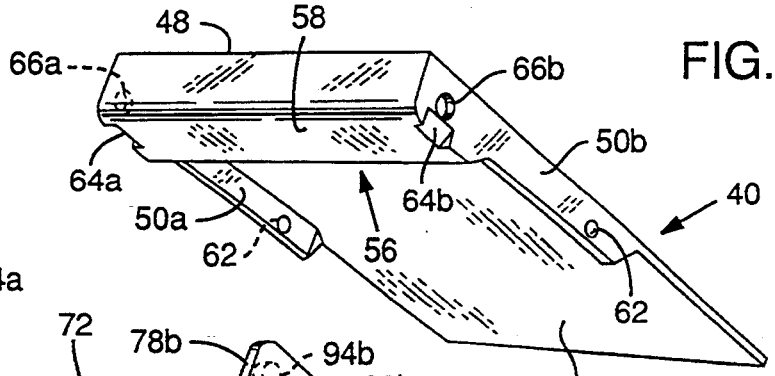
FIG. 1 shows an isometric view of a top piece of a multisection card case according to one embodiment of the invention.

FIG. 1 shows an isometric view of a top piece 40 of a multisection card case 10 according to the invention. The top piece 40 includes a planar member 46 having a linear edge 48, and first and second walls 50*a*, 50*b* perpendicular to the linear edge 48 and to the planar member 46. The preferred top piece further includes coupling features for coupling the top piece 40 to an adjacent case section, and a cavity 56 formed by the first and second walls 50*a*, 50*b* and by a cover member 58 extending from the linear edge 48, becoming parallel with the planar member 46. The cavity 56 holds, for example, a PCMCIA card in place within a case section.

Figure 7:
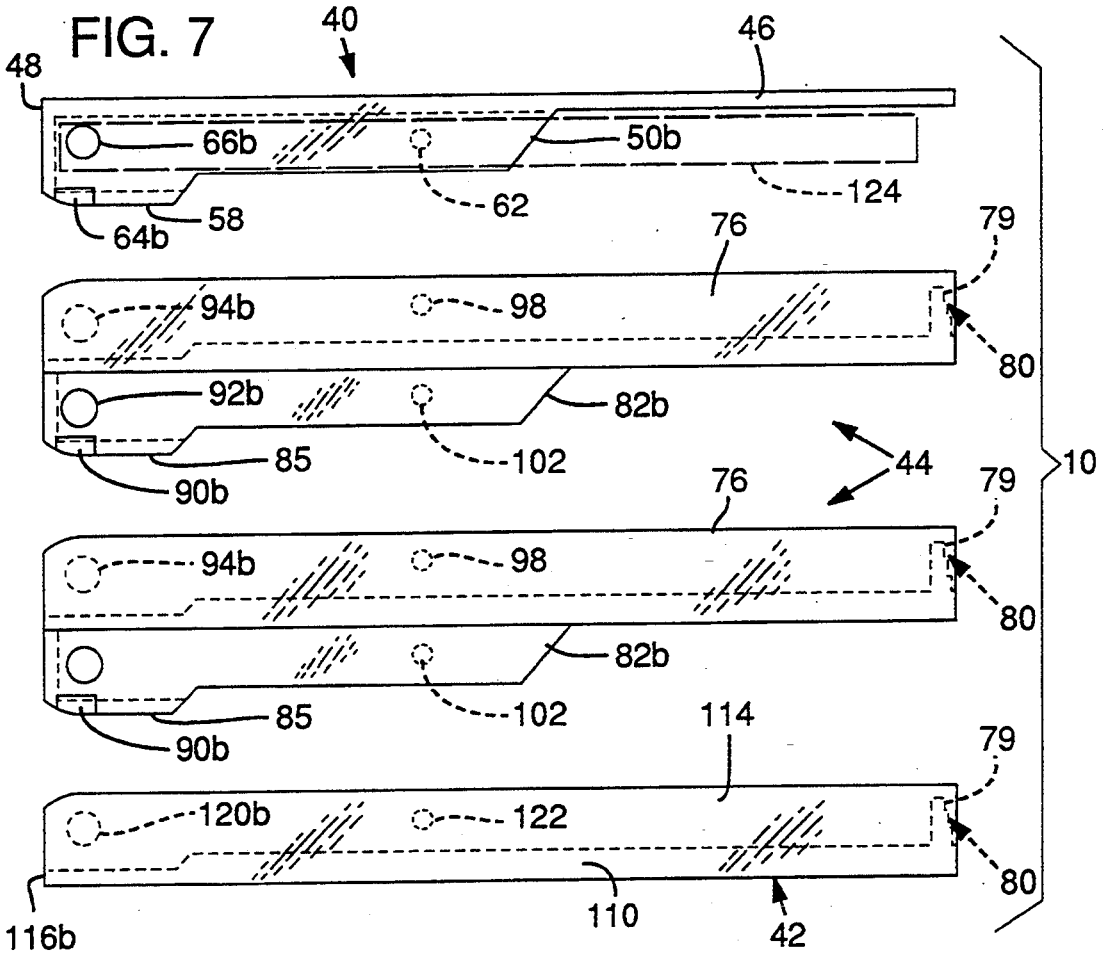
FIG. 7 shows an external side view of the card case of FIG. 5 when disassembled.

FIG. 1, together with the profile view of FIG. 7, illustrate the details of the first and second walls 50*a*, 50*b* and the cover member 58 of the top piece 40. As can be seen, the first and second walls slope toward the surface of the planar member. Abutting the walls, the cover member 58 extends from the planar member 46 and then angles at substantially a 90° angle to become parallel with the planar member 46. Both the cover member 58 and the first and second walls 50*a*, 50*b* are rounded to facilitate the unhindered rotation of the top piece 40 upon opening.

The coupling features of the top piece 40 may include small protrusions 62 and inclines 64*a*, 64*b* leading to small holes 66*a*, 66*b* in the first and second walls 50*a*, 50*b*. The small protrusions 62 engage adjacent case sections when the adjacent section is closed. The small holes 66*a*, 66*b* serve as pivot points between the adjacent section, and the inclines 64*a*, 64*b* facilitate the connection between the adjacent sections.

Figure 2:
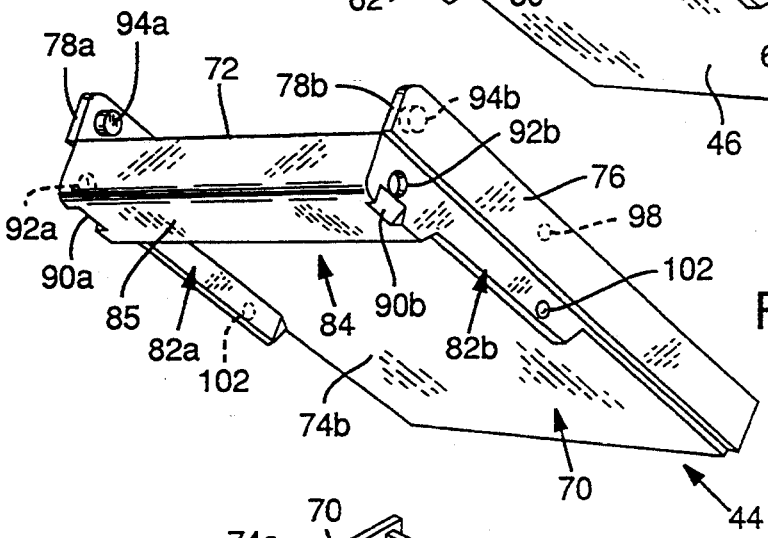
FIG. 2 shows an isometric view of an intermediate piece of a multisection card case.
Figure 3:
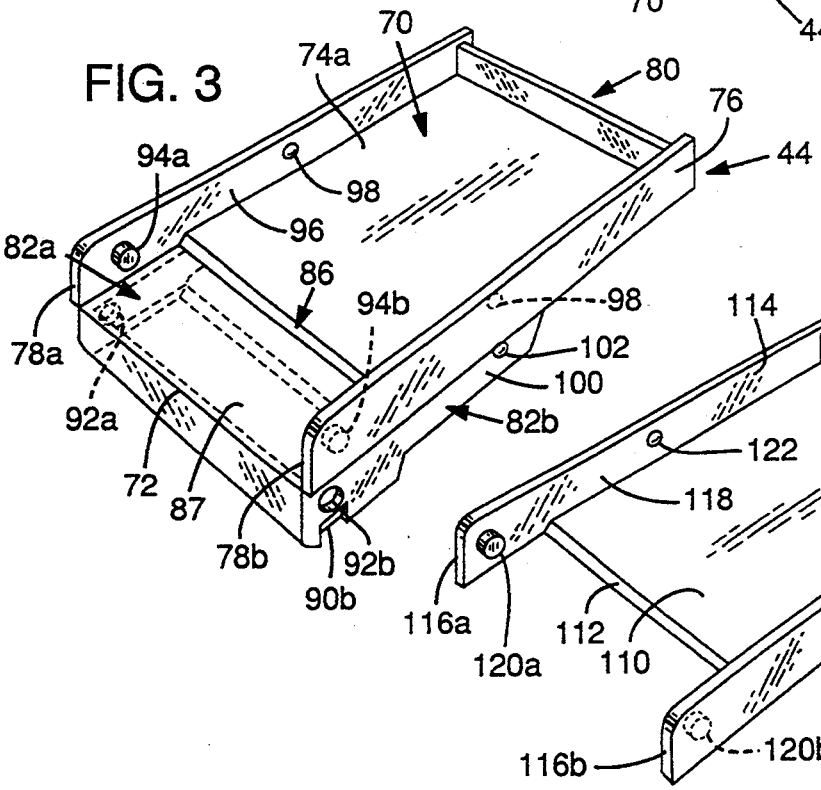
FIG. 3 shows a perspective view of an intermediate piece of a multisection card case.
Figure 5:
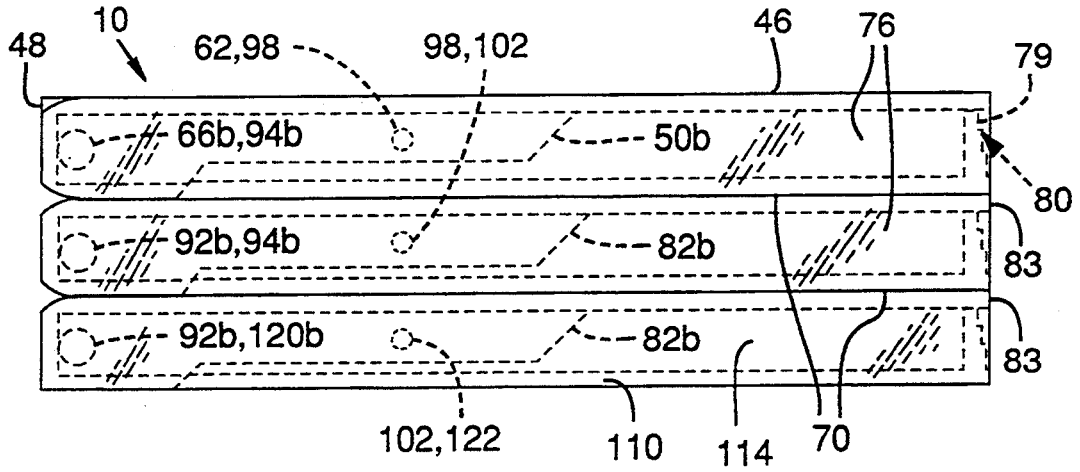
FIG. 5 shows an external side view of an assembled card case according to one embodiment of the present invention.
Figure 6:
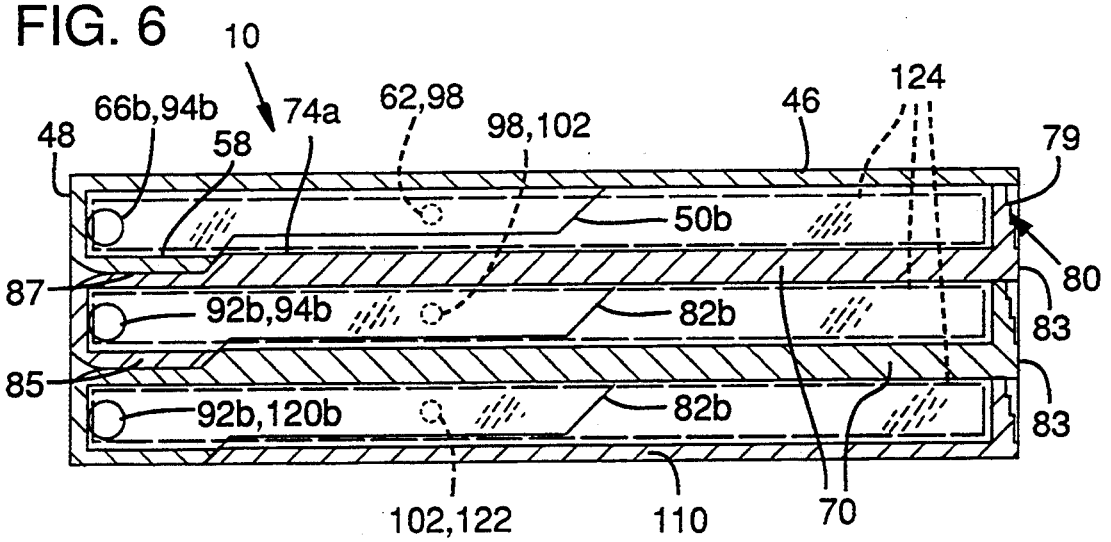
FIG. 6 shows a cross sectional side view of the card case of FIG. 5.

FIGS. 2–3 are views of intermediate sections 44 of the multisection card case. Intermediate section 44 includes a substantially planar member 70 having a linear edge 72 and a top and bottom side 74*a*, 74*b*. The intermediate section further includes a top wall 76 extending in a perpendicular direction from the top side 74*a* of the planar member 70 and partially surrounding the periphery of the substantially planar member. The top wall 76 has first and second rounded ends 78*a*, 78*b* perpendicular to and abutting the linear edge 72. As illustrated in FIGS. 5–7, the top wall 76 may have ridges 79 at the outer edge 80 to facilitate the opening and closing of a case section.

The intermediate section 44 includes first and second bottom walls 82*a*, 82*b*. The first and second bottom walls 82*a*, 82*b* begin at opposing ends of the linear edge 72 at the periphery of the planar member and extend from the bottom side of the substantially planar surface 70. FIG. 7 illustrates the profile view of the bottom walls and shows that the bottom walls, like the walls of the top piece 40, slope toward the substantially planar member 70. The intermediate section includes a cavity 84 for holding a card. The cavity 84 is formed by the first and second walls 82*a*, 82*b* and by a cover member 85. The cover member 85 extends from the linear edge 72 and then bends at substantially a 90° angle to become parallel with the planar member 70. FIG. 3 illustrates that the top side 74*a* of the substantially planar member 70 has a step or jog 86 on the top side 74*a* leading to a depression 87 in the top side 74*a* that is substantially coextensive with the cover member 85 of an adjacent intermediate piece or cover member 58 of an adjacent top piece 40.

The intermediate sections include coupling features for coupling an intermediate piece 44 to an adjacent card section. FIG. 2 illustrates that the bottom walls 82*a*, 82*b* of an intermediate section 44 include inclines 90*a*, 90*b* leading to small holes 92*a*, 92*b* for engaging pegs 94*a*, 94*b* of an adjacent section 44 or bottom piece 42. FIG. 3 illustrates that the top wall 76 of an intermediate section 44 includes protruding pegs 94*a*, 94*b* for coupling an adjacent top piece 40 or another intermediate section 44. Both FIGS. 2–3 show that the inner side 96 of the top wall 76 may have a notch 98, and the outer side 100 of the bottom walls 82*a*, 82*b* may have a protrusion 102 for engaging adjacent case sections.

Figure 4:
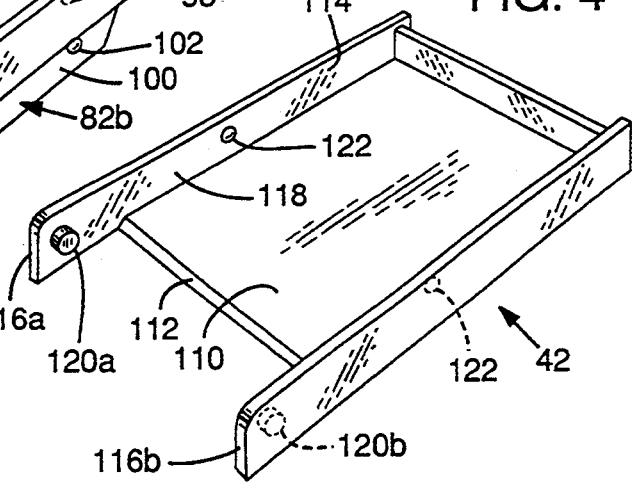
FIG. 4 shows a perspective view of a bottom piece of a multisection card case.

FIG. 4 shows a perspective view of a bottom piece 42 of the multisection card case. The bottom piece includes a planar member 110 having a linear edge 112, a top wall 114 extending above the flat planar member 110, coupling features for coupling the bottom piece to an adjacent case section.

FIG. 4 illustrates the details of the top wall of the bottom piece in the preferred embodiment. The top wall has two rounded ends 116*a*, 116*b* and extends around the periphery of the flat planar member 110 away from the linear edge 112. The ends of the top wall 114 protrude in a perpendicular direction over the linear edge 112 at the two rounded ends 116*a*, 116*b*.

The bottom piece 42 includes coupling features for coupling the bottom piece to an intermediate case section. At the inner side 118 of the top wall 114, the coupling features may include protruding pegs 120*a*, 120*b* for engaging the small holes 92*a*, 92*b* of an intermediate section 44 or holes 66*a*, 66*b* of top section 40. The coupling features may also include a notch 122 for engaging the bottom piece with protrusions 102 of an adjacent intermediate section 44 or protrusions 62 of top section 40.

To form a multisection card case, the top 40, bottom 42, and a plurality of intermediate pieces 44 may be coupled together at the pegs 94*a*, 94*b*, 120*a*, 120*b* and corresponding holes 66*a*, 66*b*, 92*a*, 92*b* of each piece. Depending on the number of intermediate pieces 44, the multisection case may contain any number of card sections. One may adjust the capacity of the multisection card case because the pieces of the card case are interchangeably connected.

In operation, the pieces of a multisection card case shown in the perspective views of FIGS. 1–4 and the external side view of FIG. 7 may be interchangeably coupled together to form a multisection card case with adjustable capacity. Each intermediate piece and the top piece provide a computer card storage section. It should be noted that the storage section may be adapted to store a variety of substantially planar objects including but not limited to compact discs, floppy discs, cassettes, etc. The term "computer card" may include and is not limited to, PCMCIA cards, floppy discs, computer memory cards, and peripherals. The term "card," may refer to any substantially planar object.

The sections may be decoupled to remove or add intermediate sections 44 and then recoupled at the pegs and corresponding holes to form a multisection card case of desired capacity. The pegs and holes enable the storage sections to be rotated about a common axis between adjacent sections to open or close a memory card storage section.

Figure 9:
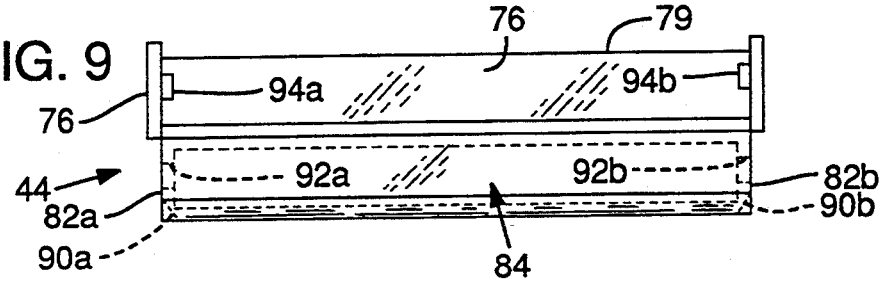
FIG. 9 shows a rear view of the intermediate piece of FIG. 2.

FIG. 5 shows an external view of an assembled multisection card case. To assemble the pieces of a card case, one may grasp the ends 78*a*, 78*b* of the top wall 76 of an intermediate piece 44 (FIG. 2) and slightly flex the walls outward. As shown in FIGS. 2 and 3, the top wall 76 is not coupled to the bottom walls 82*a*, 82*b* or to the substantially planar surface 70 near the ends 78*a*, 78*b* of the top wall. The top wall 76 merely abuts the bottom walls 82*a*, 82*b* at an edge as shown in FIG. 9, which enables the top wall to flex outward. Placing the small pegs 94*a*, 94*b* of the top wall 76 on the inclines 90*a*, 90*b* of an adjacent intermediate piece, one may then slide the pegs 94*a*, 94*b* toward the holes 92*a*, 92*b*. The pieces become coupled when the pegs snap into place.

Once assembled, one may access any section of the multisection card case. To open a section, one may rotate a section about a common axis between adjacent sections by grasping the ridges 79 of the outer wall 80 enclosing a section and lifting an edge 83 of the substantially planar member away from the outer wall 80. To close a section, one may rotate the sections toward each other to engage the protrusions 102 and notches 98 of adjacent pieces. Portions of the intermediate 44, top 40, and bottom 42 pieces are rounded at an edge near the axis of rotation to facilitate easy opening and closing. Each section is equally accessible, and any number of sections may be opened at once.

Figure 8:
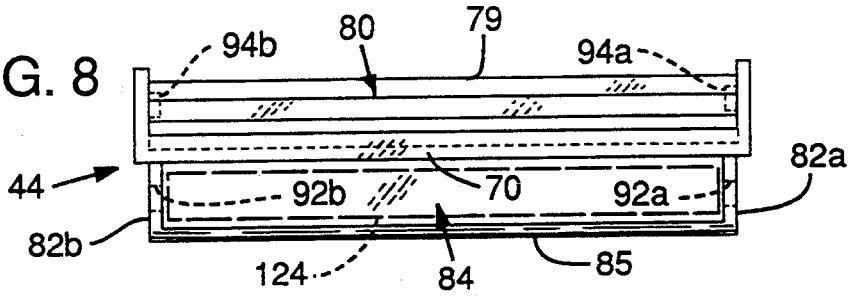
FIG. 8 shows a front view of the intermediate piece of FIG. 2.

FIG. 6 shows cross sectional side view of an assembled multisection card case. When the case is closed, the cover member 85 of an intermediate piece is flush with the substantially planar member 70 of an adjacent piece because the top side of the planar member 74*a* has a depression 87. Because of this depression 87, a card 124 stored in a case section will be held flush and firmly against adjacent surfaces of planar members. To achieve this smooth fit, the substantially planar member 70 has an area of double thickness away from the depression. A card 124 fits into cavities 56, 84 as shown in FIGS. 7 and 8, and becomes flush with planar surfaces 46, 70 and walls 82, 76 of a card storage section as shown in FIG. 6. As shown in the front and rear views of an intermediate case section of FIGS. 8–9, respectively, the bottom walls 82*a*, 82*b* slide inside the top wall 76 of the intermediate pieces to form the lateral sides of the card storage section. Together a cavity 84, the surrounding walls 76, 82, and adjacent planar surfaces 70 form the enclosure of a card storage section.

FIG. 7 shows an external side view of a disassembled multisection card case. To disassemble the multisection card case, one flexes the ends 78*a*, 78*b* of a top wall 76 of an intermediate piece 44 outward sufficiently to disengage a peg 94*b* from a hole 92*b* . Once a peg is disengaged, adjacent pieces slide apart at the incline 90. After disassembling the multisection card case, one may add or remove intermediate pieces as desired. The capacity of the multisection card case is thus fully adjustable.

Having illustrated and described the principles of the invention in a preferred embodiment, it should be apparent to those skilled in the art that the invention can be modified in arrangement and detail without departing from such principles. For example, the pieces of the multiple section card case can be coupled in a variety of different ways. While the preferred embodiment utilizes an arrangement with a single pivot axis shared between adjacent sections, in other embodiments there can be two (or more) pivot axes between adjacent sections. In still other embodiments, rather than an identifiable pivot axis, coupling can be achieved by flexible coupling members extending between adjacent sections. A short length of looped adhesive tape is but one example of such an arrangement. It will further be recognized that the individual section components can be molded in shapes different than those depicted, while still retaining the advantages of the present invention.

In view of the many possible embodiments to which the principles of my invention may be put, it should be recognized that the detailed embodiment is illustrative only and should not be taken as limiting the scope of my invention. Rather I claim as my invention all such modifications as may come within the scope and spirit of the following claims and equivalents thereto.

I claim:

1. A multiple section card case comprising at least two case sections, at least one case section having a substantially planar member and a wall extending from the substantially planar member, the at least one case section interchangeably coupled to an adjacent case section, the at least one case section and the adjacent case section operably coupled to rotate about an axis, the substantially planar member and the wall of the at least one case section cooperating with the adjacent case section to form a repository for a card;

the multiple section card case including a top piece, a bottom piece, and a plurality of intermediate pieces;

wherein each piece in cooperation with an adjacent piece forms a case section operable to completely enclose a card;

the intermediate pieces each including:

a substantially planar member having a linear edge and a top and bottom side;

a top wall extending in a perpendicular direction from the top side of the substantially planar member and partially surrounding the periphery of the substantially planar member, the wall having first and second rounded ends abutting the linear edge;

first and second walls at opposing ends of the linear edge at the periphery of the substantially planar member extending from the bottom side of the substantially planar member;

a cavity formed by the first and second walls and by a cover member extending from the linear edge and becoming parallel with the substantially planar member; and coupling means for coupling an intermediate piece to an adjacent piece; and the substantially planar member having a depression on the top side that is substantially coextensive with the cavity on the bottom side.

2. A multiple section card case comprising:

at least two intermediate case sections, each intermediate case section including a first and second coupling means, a planar member, a bottom side, top wall projecting outwardly in a first direction from the planar member, a cover member attached to the bottom side and a pair of bottom walls projecting outwardly in a second direction from the bottom side, the cover member and bottom walls forming a cavity for retaining a card adjacent to the bottom side when the card case is in an open position, the top wall defining a card receiving opening which communicates with the interior of the case section, the first coupling means of an intermediate case section being pivotally coupled to the second coupling means of an adjacent intermediate case section such that the pivotally coupled case sections pivot relative to one another about a pivot axis between a closed position in which the intermediate case sections are stacked together and the open position in which the intermediate case sections are not stacked together, the bottom walls of the intermediate case section positioned to engage the top wall of the adjacent case section to lock said intermediate case sections in the closed position.

3. The multiple section card case of claim 2 wherein the bottom side is offset from the top wall of an adjacent case section such that the bottom side of said case section fits within the top wall of said adjacent case section when the bottom side and the adjacent case section are stacked together.

4. The multiple section card case of claim 2 wherein the intermediate case sections are interchangeably coupled together with a snap fit.

5. The multiple section card case of claim 2 wherein the cover member is positioned on the bottom walls to define a cavity for receiving a portion of a card.

6. The multiple section card case of claim 2 wherein the first coupling means includes at least one engaging peg.

7. The multiple section card case of claim 6 wherein the second coupling means includes at least one small hole, wherein the engaging peg engages the small hole to couple the intermediate case sections.

8. The multiple section card case of claim 2 wherein the bottom walls of the intermediate section includes a protrusion.

9. The multiple section card case of claim 8 wherein the top wall of the adjacent case includes a notch, the protrusion of the intermediate section engaging the notch of the adjacent case section to lock the intermediate case sections in the closed position.

10. A multiple section card case comprising:

a first case section including a bottom side, a bottom wall projecting outwardly from the bottom side, and a cover attached to the bottom side, the cover and bottom wall forming a cavity for retaining a card adjacent to the bottom side when the card case is in an open position;

an adjacent case section including a top wall to form a card receiving opening;

coupling means attached to the bottom wall of the first section and the top wall of the adjacent section for pivotally coupling the first case section to the adjacent case section such that the pivotally coupled case sections pivot about an axis relative to one another between the open position in which the case sections are not stacked together and a closed position in which the case sections are stacked together; and the bottom side, cover and bottom wall of the first section cooperating with the top wall of the adjacent section for closing the card receiving opening when the case sections are in the closed position to form a repository for the card.

11. The multiple section card case of claim 10 in which the coupling means of at least one case section is interchangeably coupled to the coupling means of the adjacent case section at an axis, and the at least one case section and the adjacent case section are operably coupled to pivot about said axis.

12. The multiple section card case of claim 10 wherein the bottom side comprises a first and second bottom wall projecting outwardly from the bottom side, the first and second bottom walls of the bottom side positioned to engage the top wall of the adjacent case section when said case section and the adjacent case section are stacked together to lock the case section and adjacent case section in the closed position.

13. The multiple section card case of claim 10 wherein the axis between a case section and the adjacent case section is located in a middle portion of the bottom wall of the case section.

14. The multiple section card case of claim 10 wherein the bottom wall and cover member form a cavity therein.

* * * * *